US007118275B2

(12) United States Patent
Chabin et al.

(10) Patent No.: US 7,118,275 B2
(45) Date of Patent: Oct. 10, 2006

(54) X-RAY EMISSION DEVICE AND METHOD OF ASSEMBLY

(75) Inventors: Eric Chabin, Montigny-le-Bretonneux (FR); Xavier Le Pennec, Trappes (FR)

(73) Assignee: GE Medical Systems Global Technology Company LLC, Waukesha, WI (US)

( * ) Notice: Subject to any disclaimer, the term of this patent is extended or adjusted under 35 U.S.C. 154(b) by 0 days.

(21) Appl. No.: 09/859,925

(22) Filed: May 17, 2001

(65) Prior Publication Data

US 2002/0015472 A1 Feb. 7, 2002

(30) Foreign Application Priority Data

May 19, 2000 (FR) ..... 00 06467

(51) Int. Cl.
*H05G 1/02* (2006.01)

(52) U.S. Cl. ..... 378/197

(58) Field of Classification Search ..... 378/119, 378/121, 125, 140, 143, 144, 205, 195, 202, 378/132

See application file for complete search history.

(56) References Cited

U.S. PATENT DOCUMENTS 5,303,280 A * 4/1994 Crawford et al. ..... 378/132
5,581,591 A 12/1996 Burke et al. ..... 378/135
6,592,258 B1 7/2003 Chabin et al.

FOREIGN PATENT DOCUMENTS

| | | |
|---|---|---|
| DE | 19824008 | 12/1999 |
| EP | 0351225 | 1/1990 |
| EP | 0456539 | 11/1991 |
| EP | 0972490 | 1/2000 |
| WO | WO 9744809 | 11/1997 |

* cited by examiner

*Primary Examiner*—Craig E. Church
(74) *Attorney, Agent, or Firm*—Cantor Colburn LLP; Jay L. Chaskin

(57) ABSTRACT

An X-ray emission device and a method of assembly of the device having a casing with a window and an X-ray tube place in the casing. The tube comprises an anode assembly equipped with an anode, a cathode assembly equipped with a cathode and an envelope containing the anode and the cathode. The longitudinal positioning of the X-ray tube in the casing is produced on the anode side. The angular positioning of the X-ray tube in the casing on a longitudinal axis is produced on the anode side. A bayonet on the casing fastens a rotation axis support for the anode. The cathode is fixed in an angular position predetermined in relation to the bayonet by pins.

23 Claims, 6 Drawing Sheets

X-RAY EMISSION DEVICE AND METHOD OF ASSEMBLY

CROSS REFERENCE TO RELATED APPLICATIONS

This application claims the benefit of a priority under 35 USC 119 to French Patent Application No. 0006467 filed May 19, 2000, the entire contents of which are incorporated by reference.

BACKGROUND OF THE INVENTION

The present invention concerns the field of radiology apparatus and, in particular, the assembly of such an apparatus.

A radiology apparatus used, for example, in mammography, RAD or RF conventional radiology and neurological or even vascular (peripheral or cardiac) radiology generally comprises: an X-ray tube and a collimator for forming and delimiting an X-ray beam; an image receiver, generally a radiological image intensifier and a video camera, or even a solid-state detector; a positioner carrying the X-ray tube and collimator assembly on one side and image receiver on the other, movable in space on one or more axes, and a table for supporting a patient. An example of such an apparatus is disclosed in EP-A-972,490 and the apparatus has use in x-ray imaging.

An X-ray tube mounted, for example, in a medical radiology apparatus comprises a cathode and an anode, both contained in a vacuum-tight envelope, for electric insulation between the two electrodes. The cathode produces an electron beam which is received by the anode on a small surface constituting a focus from which the X-rays are emitted.

On application of a high voltage by a generator at the terminals of the cathode and anode, a so-called anode current is established in the circuit through the generator producing the high voltage. The anode current crosses the space between the cathode and anode in the form of an electron beam which bombards the focus.

In order to obtain a high-energy electron beam, the electrons are accelerated by an intense electric field produced between the cathode and anode. For that purpose, the anode is brought to a very high positive potential in relation to the cathode. That potential can exceed 150 kV. To produce those potentials, high-voltage supply devices are used.

A part of the X-ray emission from the focus crosses the envelope and then the window of the casing. The window being of small dimensions, the cathode, anode and window have to be mounted in given relative positions that are precise and reproducible. Furthermore, the collimator is mounted outside the casing and is crossed by the X-ray beam. As a result, the position of the focus and the position of the axis of propagation of the X-ray beam, in other words, the position of the X-ray beam, have to be perfectly defined, notably, in relation to the casing. The position of the point of emission or focus of the X-ray beam is determined by three translations and three rotations of the X-ray tube in relation to the casing in a three-dimensional reference. Two of the positions in translation and two of the positions in rotation are obtained by design. However, the position in translation along the axis of rotation of the anode and the position in rotation on the same axis require adjustments requiring highly skilled labor, a considerable time and tools. In particular, it often proves indispensable to carry out X-ray emissions following which the apparatus is disassembled in order to perfect the adjustment and is reassembled, and so on until obtaining the desired positioning making it possible to satisfy radiation protection standards and to obtain good-quality images. Such an apparatus is disclosed in WO A 97/44809.

BRIEF DESCRIPTION OF THE INVENTION

An embodiment of the invention is directed to an economical method of assembly of x-ray tube for a radiology apparatus.

An embodiment of the invention is directed to a method of assembly with positioning obtained by design.

The method of assembly, according to one aspect of the invention, is intended for a radiology apparatus X-ray emission means. The emission means comprises a casing opened by a window and an X-ray tube placed in the casing. The X-ray tube comprises an anode assembly equipped with an anode, a cathode assembly equipped with a cathode and an envelope. The anode and the cathode are placed in the envelope in order to emit an X-ray beam passing through the window. The longitudinal positioning of the X-ray tube in the casing is produced on the anode side and the angular positioning of the X-ray tube in the casing on a longitudinal axis is produced on the anode side.

The invention is also directed to an X-ray emission device intended for a radiology apparatus. The device comprises a casing opened by a window and an X-ray tube placed in the casing. The X-ray tube comprises an anode assembly equipped with an anode, a cathode assembly equipped with a cathode and an envelope, the anode and the cathode being placed in the envelope in order to emit an X-ray beam passing through the window. The anode assembly comprises a means of longitudinal positioning of the X-ray tube in the casing and a means of angular positioning of the X-ray tube in the casing on a longitudinal axis.

The invention is also directed to an X-ray emission device intended for a radiology apparatus. The device comprises a casing opened by a window and an X-ray tube placed in the casing. The X-ray tube comprises an anode assembly equipped with an anode, a cathode assembly equipped with a cathode and an envelope, the anode and the cathode being placed in the envelope in order to emit an X-ray beam passing through the window. The anode assembly comprises a bayonet for angularly positioning the X-ray tube in the casing on a longitudinal axis and for fastening the X-ray tube to the casing.

A radiology apparatus X-ray emission device is thus obtained, the X-ray beam of which is positioned with great precision, while being simple to assemble.

DETAILED DESCRIPTION OF THE INVENTION

Figure 1:
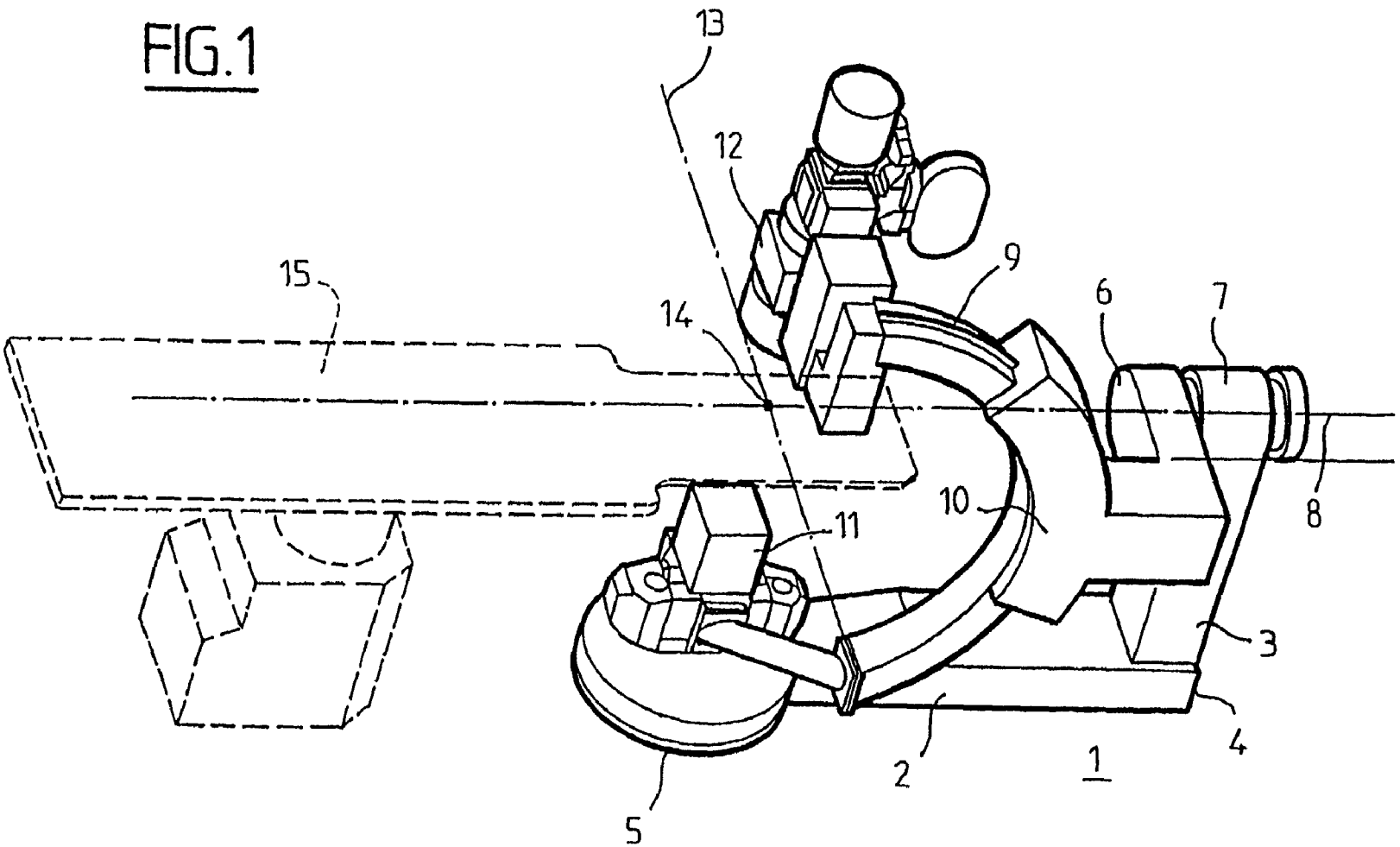
FIG. 1 is a view in perspective of a radiology apparatus with three axes, which can be used to apply the method according to an embodiment of the invention.

The anode assembly comprises an anode shaft integral with the anode, a rotation axis support and an electric drive motor of the anode equipped with a stator and a rotor, one reference surface is formed on the rotation axis support, one reference surface is formed on the casing and both reference surfaces are brought in contact.

In one embodiment of the invention, the axial distance between the reference surface of the rotation axis support and the zone of the anode from which the X-ray beam is emitted is predetermined.

In one embodiment of the invention, the axial distance between the reference surface of the casing and the window is predetermined.

In another embodiment of the invention, the rotation axis support is fastened by a bayonet on the casing. The cathode can be fixed in an angular position predetermined in relation to the bayonet.

The cathode assembly comprises feed pins and crossing the envelope, the pins are fastened in an angular position predetermined in relation to the cathode. In an embodiment of the invention, the cathode assembly being integral with a portion of the envelope, the portion of the envelope is fastened on another portion of the envelope integral with the anode assembly, with the pins in an angular position predetermined in relation to the anode assembly. In an embodiment of the invention, the pins are fastened in a position aligned with the cathode.

In an embodiment of the invention, the angular positioning of the X-ray tube in the casing on a longitudinal axis is accomplished by contact of a bayonet of the anode assembly with a surface integral with the casing.

The surface integral with the casing can be formed by the bottom of a ramp formed in a flange integral with the casing.

The bayonet is generally integral with a non-revolving part of the anode assembly. A means complementing the bayonet can be integrated with the casing.

The anode assembly may comprise a reference surface capable of cooperating with a corresponding reference surface formed on the casing. The reference surface can be machined.

The cathode assembly may comprise feed pins crossing the envelope, the pins being fastened in an angular position predetermined in relation to the cathode. The cathode assembly being integral with a portion of the envelope, the portion of the envelope is fastened on another portion of the envelope integral with the anode assembly, with the pins in an angular position predetermined in relation to the anode assembly.

In an embodiment of the invention, the pins are in a position aligned with the cathode.

In an embodiment of the invention, the anode assembly comprises an anode shaft integral with the anode, a rotation axis support and an electric drive motor of the anode equipped with a stator and a rotor. One reference surface is provided on the rotation axis support, one reference surface is provided on the casing and both reference surfaces are in contact.

In an embodiment of the invention, the rotation axis support comprises a bayonet capable of cooperating with a corresponding part of the casing for the fastening of the axis support.

As shown in FIG. 1, the radiology apparatus contains an L-shaped stand 1 with a generally horizontal base 2 and a generally vertical support 3 fastened to an end 4 of the base 2. At the opposite end 5, the base 2 contains an axis of rotation parallel to the support 3 and on which the stand is capable of turning. A support arm 6 is fastened at a first end to the top 7 of the support 3, rotating on an axis 8. The support arm 6 can take the shape of a bayonet. A C-shaped circular arm 9 is maintained by another end 10 of the support arm 6. The C-shaped arm 9 is capable of sliding rotating on an axis 13 relative to the end 10 of the support arm 6.

The C-shaped arm 9 supports an X-ray emission means 11 and an X-ray detector 12 in diametrically opposite positions facing each other. The detector 12 contains a flat detection surface. The direction of the X-ray beam is determined by a straight line joining a focal point of the emission means 11 to the center of the flat surface of the detector 12. The axis of rotation of the stand 1, the axis 8 of the support arm 6 and the axis 13 of the C-shaped arm 9 are secant at a point 14 called isocenter. In mid-position, those three axes are perpendicular to one another. The axis of the X-ray beam also passes through point 14.

A table 15, provided to accommodate a patient, possesses a longitudinal orientation aligned with axis 8 in rest position.

Figure 2:
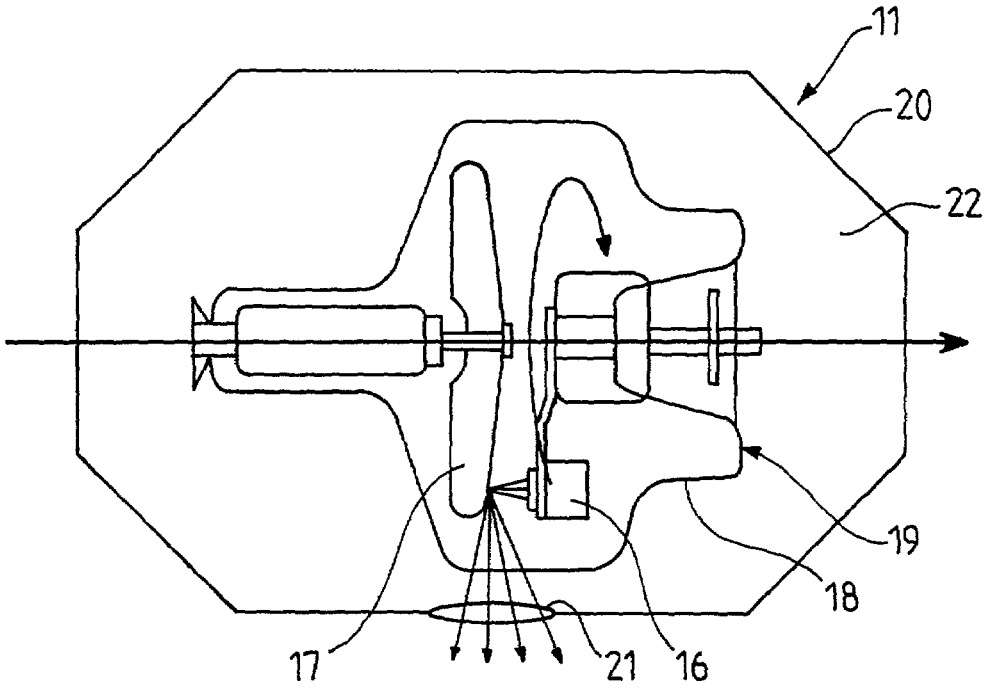
FIG. 2 is a schematic view of an X-ray tube.
Figure 3:
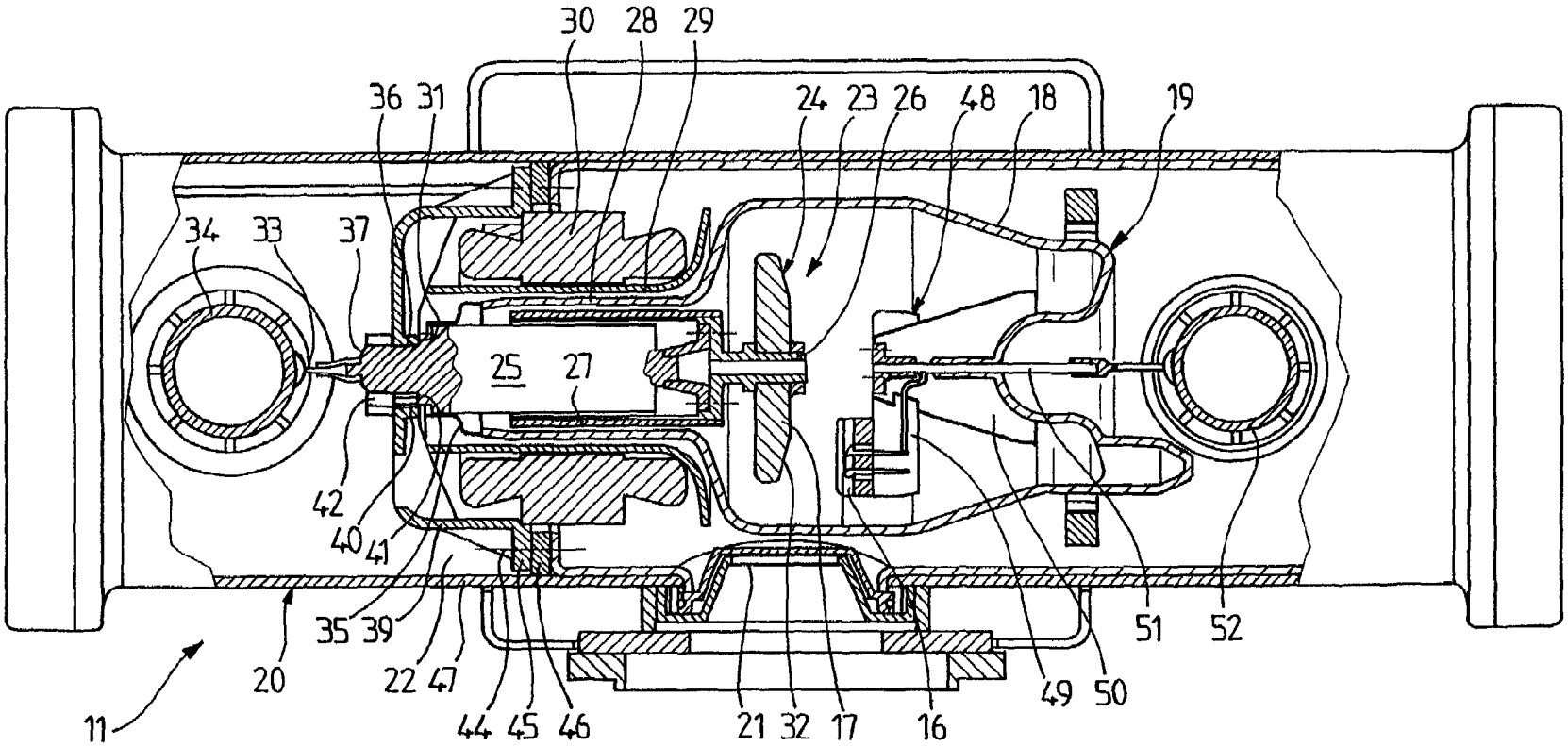
FIG. 3 is an axial section of an X-ray tube according to an embodiment of the invention.
Figure 4:
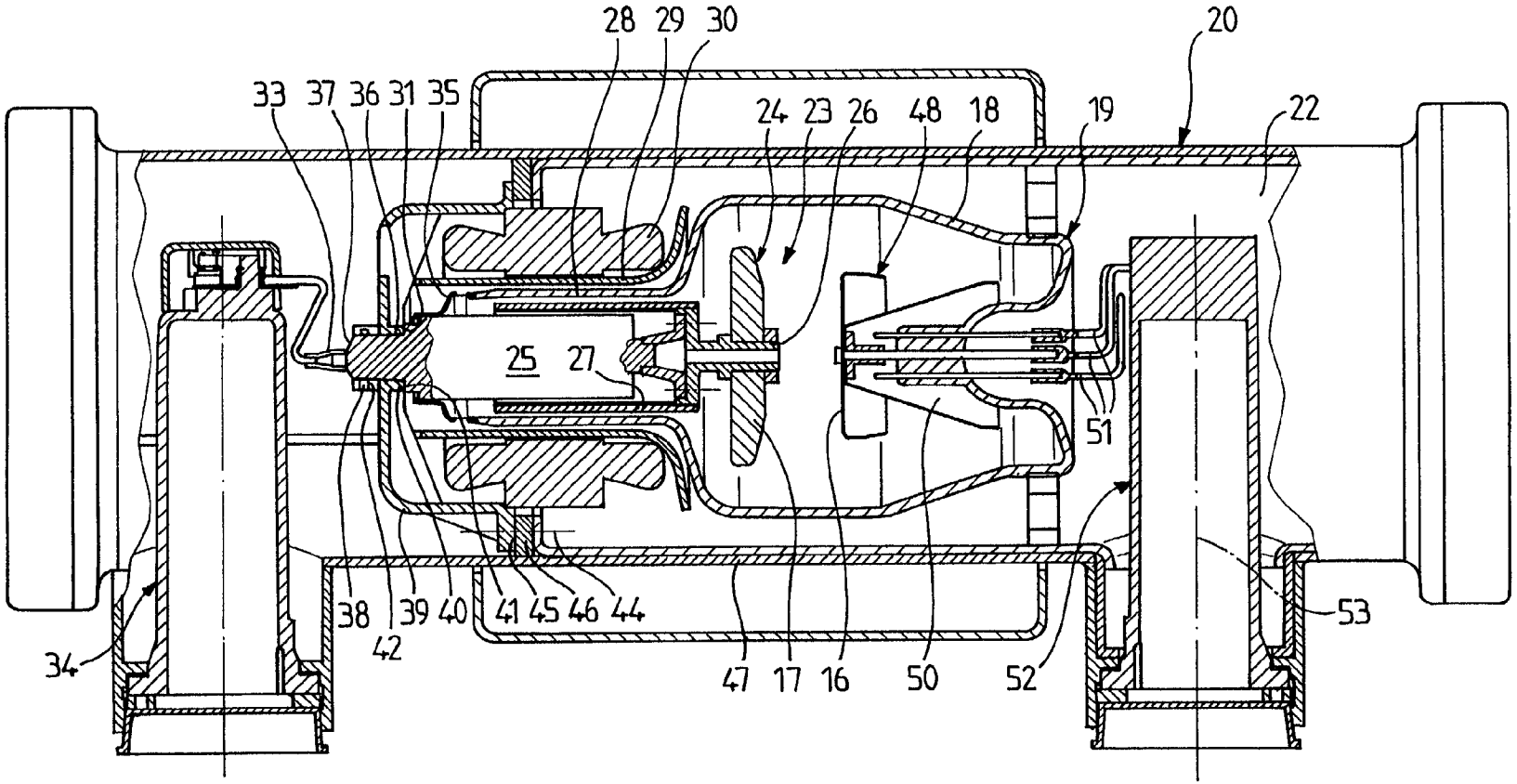
FIG. 4 is an axial view of the same X-ray tube along a cut plane perpendicular to that of FIG. 2.
Figure 5:
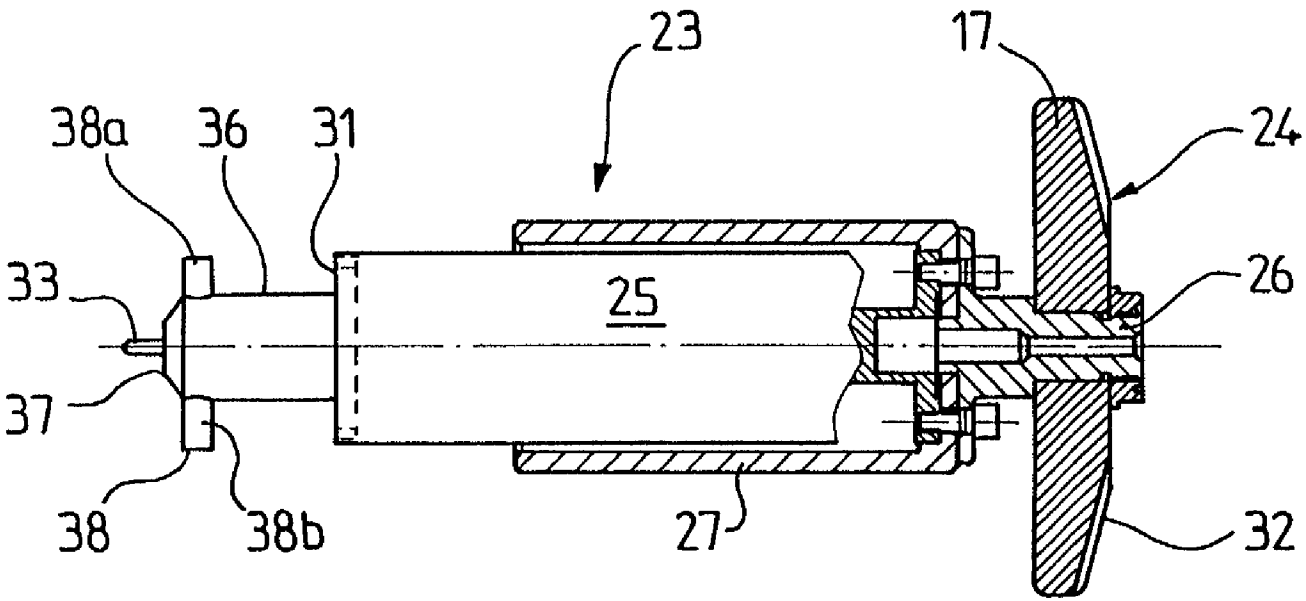
FIG. 5 is a view partially in axial section and partially in side elevation of an anode assembly of the X-ray tube of FIGS. 3 and 4.
Figure 6:
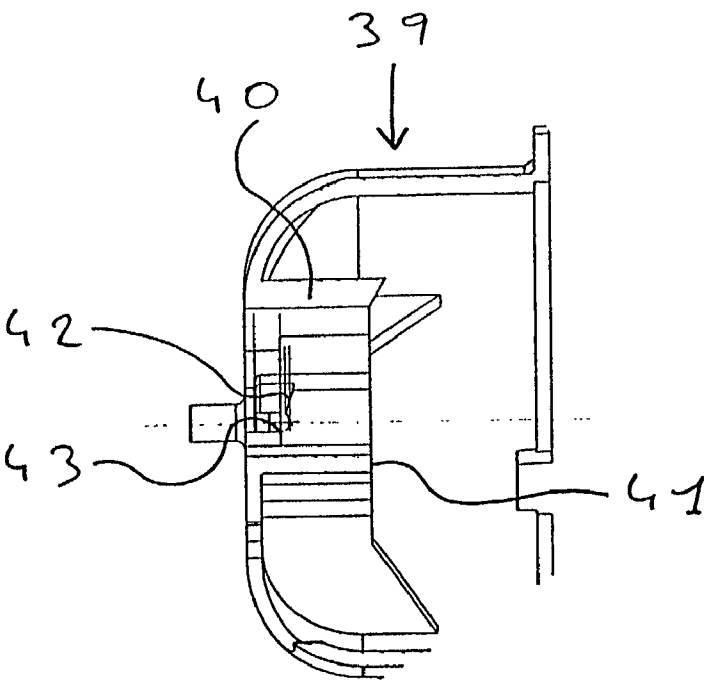
FIG. 6 is an axial section of a flange of the X-ray tube of FIGS. 3 and 4.

As FIG. 2 shows, the X-ray emission means 11 comprises a cathode 16 and an anode 17 contained in an envelope 18 transparent to X-rays. The assembly or X-ray tube 19 consisting of the cathode 16, the anode 17 and the envelope 18 is in turn contained in a casing 20 opaque to X-rays, except for a part situated opposite the X-ray beam emitted by the anode 17, which consists of a window 21 of material transparent to X-rays. The space between the transparent envelope 18 and the opaque casing 20 is filled with oil 22 used for electric insulation and for cooling of the X-ray source.

As is well known, the cathode 16 emits an electron beam that strikes the turning anode 17, which re-emits an X-radiation from a focal surface. The X-ray beam emitted by the anode 17 consists of radiation emanating from that focal surface, but also of extrafocal parasite radiations which are eliminated, preferably as close as possible to the emission source.

More precisely, referring to FIGS. 3 to 6, it can be seen that the anode assembly referenced 23 comprises elements that are at the same voltage as the anode 17. The anode assembly 23 comprises a turning part 24 and of a non-turning part 25. The turning part 24 contains, in addition to the anode 17, a support shaft 26 of the anode 17 and a rotor 27, for example, of cage winding type. Roller bearings, not represented, can be provided to support the turning part 24 at high angular velocities in the order of 10,000 revolutions per minute.

The non-turning part 25 is generally cylinder-shaped and placed radially between the shaft 26 it supports and the rotor 27, placed in turn inside and at a short distance from a tubular portion 28 of the casing 18. Outside and around the tubular portion 28, an electric insulator 29 and a stator 30 are arranged. The rotor 27, the electric insulator 29 and the stator 30 form an electric motor capable of driving the anode 17. The electric insulator 29 and the stator 30 are supported by the casing 20 and are separated by a short distance from the tubular portion 28.

The non-turning part 25 is provided, at its end opposite the anode 17, with a ring-shaped reference surface 31, whose axial distance from the anode 17 and, in particular, from the X-ray emission focus 32, is determined by the manufacturing dimensions of the intermediate parts such as the shaft 26 and the bearings and known with great precision. A pin 33 is fastened to the non-turning part 25 beyond the reference surface 31. The pin 33 is in turn connected to a high-voltage supply, not represented, by means of a bushing 34 formed in the casing 20. In other words, the axial distance between the focus 32 and the reference surface 31 is constant and reproducible.

The tubular portion 28 of the envelope 18 ends in a collar 35, tightly fastened, for example, by welding to the non-turning part 25 in order to enable a vacuum to be maintained inside the envelope 18.

From the reference surface 31 and axially toward the pin 33, the non-turning part 25 is provided with a cylindrical surface 36 extending from the narrow diameter of the reference surface 31 and with an end surface 37. The casing 20 contains a flange 39 provided with a ring-shaped tubular portion 40 of diameter adapted to that of the cylindrical surface 36. The tubular portion 40 is provided with a radial end surface 41 forming a reference surface capable of being in contact with reference surface 31.

On the cylindrical surface 36, a transverse bayonet 38 is formed, containing two diametrically opposite fingers 38*a* and 38*b* directed radially outward. The fingers 38*a* and 38*b* are of unequal lengths, the length being taken between the cylindrical surface 36 and the free end of each finger 38*a*, 38*b*. The precise angular position of the non-turning part 25 can thus be determined and not at just $\pi$ radians, as in case the fingers were of equal lengths.

In the tubular portion 40, two ramps 42 are hollowed out in dimensions adapted to the bayonet 38, open on the side of the radial surface 41 and of identical shape. The ramps 42 can be spiral or even L-shaped with a roughly axial entry zone and a roughly radial locking zone. In any event, the ramps 42 are provided with bottoms 43 of angular position defined in relation to the flange 39 in which the bottoms 43 are formed and, consequently, of angular position defined in relation to the casing 20 and to the window 21. The angular position of the bayonet 38 in relation to the cathode 16 is also precisely defined. In other words, contact of the bayonet 38 with the bottoms 43 of the ramps 42 secures the angular positioning of the X-ray tube 19 in the casing 20.

The flange 39 is fastened by means of a plurality of screws 44 axially oriented on a radial surface 45 of a ring 46 fastened inside a tubular part 47 of the casing 20. The tubular part 47 also supports the window 21. The flange 39 is angularly positioned relative to the window 21. The positioning can be secured by means of a slug integral with the ring 46 or flange 39 or by means of a circumferentially irregular distribution of screws 44, for example, with three screws 44 spaced two-by-two 90°.

The axial position of reference surface 41 relative to the center of the window 21 is defined and known with great precision. Thus, the axial position of the focus 32 relative to the center of the window 21 is defined and known with great precision by design and not by adjustment with successive approximations.

The cathode assembly referenced 48 as a whole contains elements that are at the same voltage as the cathode 16. The cathode assembly 48 comprises, in addition to the cathode 16, an arm forming a cam 49 and supporting the cathode 16 and a center part 50 supporting the arm 49 and in contact with the end of the envelope 18 opposite the anode 17.

A plurality of parallel pins 51, three here, tightly cross the envelope 18, being axially oriented. One of the pins can be coaxial with the shaft 26 and the other pins placed in the same plane, for example, the cut plane of FIG. 2. The pins 51 are connected to a high-voltage supply, not represented, by means of a bushing 52 formed in the casing 20.

The angular positioning of the cathode 16 relative to the longitudinal axis of the tube 19, which is also the axis of rotation of the anode 17, makes it possible to emit the X-rays properly in relation to the window 21. The angular positioning is obtained by means of pins 51 which are mounted and fastened in a given position relative to the cathode 16 and then relative to the bayonet 38.

In the example illustrated, the pins 51 are arranged in a plane passing the longitudinal axis of the tube 19 and perpendicular to a plane passing through the cathode 16 and through the longitudinal axis of the tube 19. The positioning can be carried out before the final closure of the envelope 18 when it is still divided into a part integral with the pins 51 and a part integral with the collar 35. On final closure of the envelope 18, in other words, on sealing of its two parts, the pins 51 are angularly positioned in a given and precise manner in relation to the bayonet 38. In the example illustrated, the pins 51 and the bayonet 38 are coplanar. The angular orientation of the bayonet 38 and cathode 15 relative to the longitudinal axis of the tube 19 is constant. The angular orientation is obtained on the manufacture of the tube 19 and is therefore predictable.

Once the X-ray tube 19 is mounted and sealed, it is brought into a casing 20 equipped with the flange 39, insulator 29 and stator 30. The cylindrical surface 36 is presented and engaged in the bore of the tubular portion 40, the bayonet 38 entering the ramps 42. The X-ray tube 19 is turned on its longitudinal axis until the bayonet 38 is brought in contact with the bottoms 43 of the ramps 42. The differences in lengths between the fingers 38*a* and 38*b* then makes it possible to know the angular position of the X-ray tube 19. The angular position of the window 21 integral with the casing 20 is also known and defined. Consequently, the angular position of the cathode 16 is entirely and precisely defined in relation to the window. The bayonet 38 serves both as a means of fastening and as a means of angular positioning.

The angular positioning is thus achieved. The longitudinal positioning is secured by contact between the reference surfaces 31 and 41 and maintained by the bayonet 38 tightened in the ramps 42.

A threaded portion can possibly be provided on the non-turning part 25 beyond the radial surface 37 in order to cooperate with a nut, not represented, and complete the locking.

The bushing 52 is then fastened in the casing 20 and the pins 51 are fastened to the bushing 52.

A simple and safe assembly method is thus obtained, avoiding a complex calibration including the stages of assembly, X-ray emission, disassembly, adjustment and reassembly, possibly repeated multiple times. The cost of assembly and the risk of radiation exposure of personnel are thus reduced.

Various modifications in structure and/or steps and/or function may be made by one skilled in the art without departing from the scope of the invention.

What is claimed is:

1. A method of assembly of a means for X-ray emission, the means for emission comprising a casing opened by a window and an X-ray tube placed in the casing, the X-ray tube comprising an anode assembly equipped with an anode, a cathode assembly equipped with a cathode, a rotation axis support and means for driving the anode and an envelope, the anode and the cathode being placed in the envelope in order to emit an X-ray beam passing through the window, comprising:

positioning the X-ray tube longitudinally in the casing on the anode side;

angularly positioning the X-ray tube in the casing on a longitudinal axis on the anode side; and fastening of rotation axis support by a bayonet on the casing.

2. A method of assembly of a means for X-ray emission, the means for emission comprising a casing opened by a window and an X-ray tube placed in the casing, the X-ray tube comprising an anode assembly equipped with an anode and an anode shaft integral with the anode, a cathode assembly equipped with a cathode, a rotation axis support and means for driving the anode and an envelope, the anode and the cathode being placed in the envelope in order to emit an X-ray beam passing through the window, comprising:

positioning the X-ray tube longitudinally in the casing on the anode side;

angularly positioning the X-ray tube in the casing on a longitudinal axis on the anode side;

forming one reference surface on the rotation axis support;

forming one reference surface on the casing; and bringing both reference surfaces into contact.

3. The method according to claim 2 wherein the axial distance between the reference surface of the rotation axis support and the zone of the anode from which the X-ray beam is emitted is predetermined.

4. The method according to ciaim 2 wherein the axial distance between the reference surface of the casing and the window is predetermined.

5. The method according to claim 3 wherein the axial distance between the reference surface of the casing and the window is predetermined.

6. The method according claim 2 comprising fastening the rotation axis support by a bayonet on the casing.

7. The method according to claim 6 comprising fixing the cathode in an angular position predetermined in relation to the bayonet.

8. The method according to claim 2 wherein the cathode assembly comprises feed pins and crosses the envelope, comprising fastening the pins in an angular position predetennined in relation to the cathode.

9. The method according to claim 8 wherein the cathode assembly is integral with a portion of the envelope, comprising fastening the portion of the envelope on another portion of the envelope integral with the anode assembly, with the pins in an angular position predetermined in relation to the anode assembly.

10. The method according to claim 8 comprising fastening the pins in a position aligned with the cathode.

11. The method according to claim 9 comprising fastening the pins in a position aligned with the cathode.

12. An X-ray emission device comprising a casing opened by a window and an X-ray tube placed in the casing, the X-ray tube comprising an anode assembly equipped with an anode, a cathode assembly equipped with a cathode and an envelope, the anode and the cathode being placed in the envelope in order to emit an X-ray beam passing through the window, the anode assembly including a bayonet for angularly positioning the X-ray tube in the casing on a longitudinal axis and for fastening the X-ray tube to the casing.

13. An X-ray emission device comprising:

a casing opened by a window;

an X-ray tube placed in the casing;

the X-ray tube comprising an anode assembly equipped with an anode;

the X-ray tube comprising a cathode assembly equipped with a cathode;

the X-ray tube comprising envelope;

the anode and the cathode being placed in the envelope in order to emit an X-ray beam passing through the window;

the anode assembly comprising means for longitudinally positioning the X-ray tube in the casing;

means for angular positioning of the X-ray tube in the casing on a longitudinal axis and the anode assembly contains a reference surface capable of cooperating by contact with a corresponding reference surface formed on the casing.

14. The device according to claim 13 wherein the cathode assembly contains feed pins crossing the envelope, the pins being fastened in an angular position predetennined in relation to the cathode and, the cathode assembly being integral with a portion of the envelope, the portion of the envelope is fastened on another portion of the envelope integral with the anode assembly, with the pins in an angular position predetermined in relation to the anode assembly.

15. The device according to claim 14 comprising a rotation axis support wherein a bayonet angularly positions the X-ray tube in the casing on a longitudinal axis and fastens the X-ray tube to the casing.

16. The device according to claim 13 comprising a rotation axis support wherein a bayonet angularly positions the X-ray tube in the casing on a longitudinal axis and fastens the X-ray tube to the casing.

17. The device according to claim 13 wherein the cathode assembly contains feed pins crossing the envelope, the pins being fastened in an angular position predetermined in relation to the cathode and, the cathode assembly being integral with a portion of the envelope, the portion of the envelope is fastened on another portion of the envelope integral with the anode assembly, with the pins in an angular position predetermined in relation to the anode assembly.

18. The device according to claim 13 wherein the rotation axis support comprises a bayonet for angularly positioning the X-ray tube in the casing on a longitudinal axis and for fastening the X-ray tube to the casing.

19. A method of assembly of a means for X-ray emission, the means for emission comprising a casing opened by a window and an X-ray tube placed in the casing, the X-ray tube comprising an anode assembly equipped with an anode, a cathode assembly equipped with a cathode, a rotation axis support and means for driving the anode and an envelope, the anode and the cathode being placed in the envelope in order to emit en X-ray beam passing through the window, comprising:

positioning the X-ray tube longitudinally in the casing on the anode side;

angularly positioning the X-ray tube in the casing on a longitudinal axis on the anode side; and wherein the cathode assembly comprises feed pins and crosses the envelope, comprising fastening the pins in an angular position predetermined in relation to the cathode.

20. The method according to claim 19 wherein the cathode assembly is integral with a portion of the envelope, comprising fastening the portion of the envelope on another portion of the envelope integral with the anode assembly, with the pins in an angular position predetermined in relation to the anode assembly.

21. The method according to claim 19 comprising fastening the pins in a position aligned with the cathode.

22. An X-ray emission device comprising:

a casing opened by a window;

an X-ray tube placed in the casing;

the X-ray tube comprising an anode assembly equipped with an anode;

the X-ray tube comprising a cathode assembly equipped with a cathode;

the X-ray tube comprising envelope;

the anode and the cathode being placed in the envelope in order to emit an X-ray beam passing through the window;

the anode assembly comprising means for longitudinally positioning the X-ray tube in the casing;

means for angular positioning of the X-ray tube in the casing on a longitudinal axis;

the cathode assembly contains feed pins crossing the envelope, the pins being fastened in an angular position predetermined in relation to the cathode; and the cathode assembly being integral with a portion of the envelope, the portion of the envelope is fastened on another portion of the envelope integral with the anode assembly, with the pins in an angular position predetennined in relation to the anode assembly.

23. The device according to claim 22 comprising a rotation axis support and a bayonet for angularly positioning the X-ray tube in the casing on a longitudinal axis and for fastening the X-ray tube to the casing.

* * * * *

UNITED STATES PATENT AND TRADEMARK OFFICE

CERTIFICATE OF CORRECTION

PATENT NO. : 7,118,275 B2
APPLICATION NO. : 09/859925
DATED : October 10, 2006
INVENTOR(S) : Eric Chabin et al.

It is certified that error appears in the above-identified patent and that said Letters Patent is hereby corrected as shown below:

Column 1:
Line 64, before "considerable", delete "a".

Column 4:
Line 40, after "and", delete "of".
Line 50, after "casing", delete "18" and insert therefor --20--.

Column 6:
Line 10, after "cathode", delete "15" and insert therefor --16--.

Column 7:
Line 16, before "2", delete "ciaim" and insert therefor --claim--.

Column 8:
Line 3, after "position", delete "predetennined" and insert therefor --predetermined--

Signed and Sealed this

Thirtieth Day of January, 2007

JON W. DUDAS
*Director of the United States Patent and Trademark Office*